United States Patent [19]

Husnik

[11] Patent Number: 4,568,018

[45] Date of Patent: Feb. 4, 1986

[54] RECESSED GABLE TOP CARTON

[75] Inventor: Gerald A. Husnik, Hopkins, Minn.

[73] Assignee: International Paper Company, New York, N.Y.

[21] Appl. No.: 681,513

[22] Filed: Dec. 13, 1984

[51] Int. Cl.[4] ..... B65D 5/72

[52] U.S. Cl. ..... 229/17 G; 206/503; 229/17 R; 229/DIG. 11

[58] Field of Search ..... 229/17 R, 17 G, DIG. 11; 206/503, 509, 604, 605, 608, 611, 620

[56] References Cited

U.S. PATENT DOCUMENTS

| | | | |
|---|---|---|---|
| 1,225,705 | 5/1917 | Dyson et al. | 229/DIG. 11 |
| 2,750,096 | 6/1956 | Misch | 229/17 G |
| 2,786,597 | 3/1957 | Benson | 206/503 X |
| 3,339,820 | 9/1967 | Krzyzanowski | 229/17 R |
| 3,458,111 | 7/1969 | Leasure et al. | 229/17 R |
| 3,770,185 | 11/1973 | Reeves | 229/17 G |

*Primary Examiner*—William Price
*Assistant Examiner*—Gary E. Elkins
*Attorney, Agent, or Firm*—Richard J. Ancel; Robert J. Seman

[57] ABSTRACT

This invention is directed to an improved thermoplastic coated paperboard carton commonly employed in the packaging of milk, orange juice, and other dairy and juice products. A novel gable-top closure having an upstanding ridge with a recessed upper edge will permit a stacked carton to be supported at the ends of the ridge of the supporting carton instead of the central portion thereof to reduce damage at the bottom area of the supported carton caused by rubbing during transport.

11 Claims, 4 Drawing Figures

RECESSED GABLE TOP CARTON

BACKGROUND OF THE INVENTION

This invention relates to an improved thermoplastic coated paperboard carton and, more particularly, it is directed to a carton and to a blank for constructing the carton so as to include a gable-top closure having an upstanding ridge with a recessed upper edge to minimize the effects of a weeper condition during transport.

In the packaging of liquids, such as milk, orange juice, and other dairy and juice products, considerable use is made of gable-top cartons formed of polyethylene coated paperboard.

One situation that presents a problem to the packaging industry is the difficulty encountered in maintaining carton integrity when the liquid product is shipped over a great distance between the dairy or bottler and the customer. Repetitive physical contact or rubbing caused by shipping vibrations between, say, two stacked layers of gable-top cartons can aggravate a possible pre-existing weeper condition in the carton bottoms of an upper layer of cartons during transport.

A "weeper" describes a situation that occurs when liquid product drips from the container. It is different than a leaking carton which involves the escape of product by way of flow through an area where two pieces of board were poorly sealed together. In a weeper situation, product gets into the board by way of a hole in the inside polyethylene coating. The product saturates the board and seeps or weeps through the outside polyethylene coating before it works its way out of the carton.

During carton formation, bottom closure panels or flaps sometimes puncture the inside polyethylene coating and become embedded in the adjacent board. This creates a weeper condition. Eventually, liquid product will enter the puncture, saturate the board and outside coating, and weep from the carton.

If a weeper condition exists, the vibrations that are normally encountered during transport aggravate the situation further. Because the bottom of a filled carton has a tendency to bulge outwardly, especially in the central area of such bottom, a recessed top construction according to the present invention will minimize contact between vertically stacked gable-top cartons by permitting the bottom of the top carton to be supported at the ends of the upstanding rib or ridge of the bottom carton instead of the central portion thereof. This will reduce the amount of rubbing, and the physical damage caused thereby, that usually occurs at the sensitive central bottom area of the carton being supported.

SUMMARY OF THE INVENTION

It, therefore, is an object of this invention to provide an improved gable-top carton having an upstanding ridge with a recessed upper edge to minimize damaging contact between vertically stacked cartons by permitting the bottom surface of the top carton to have less contact with the recessed ridge construction of the bottom carton.

Other objects, features and advantages of the present invention will be more fully understood from the following detailed description of a preferred embodiment of the invention, especially when that description is read in conjunction with the accompanying drawings.

DETAILED DESCRIPTION OF THE PREFERRED EMBODIMENT

Figure 1:
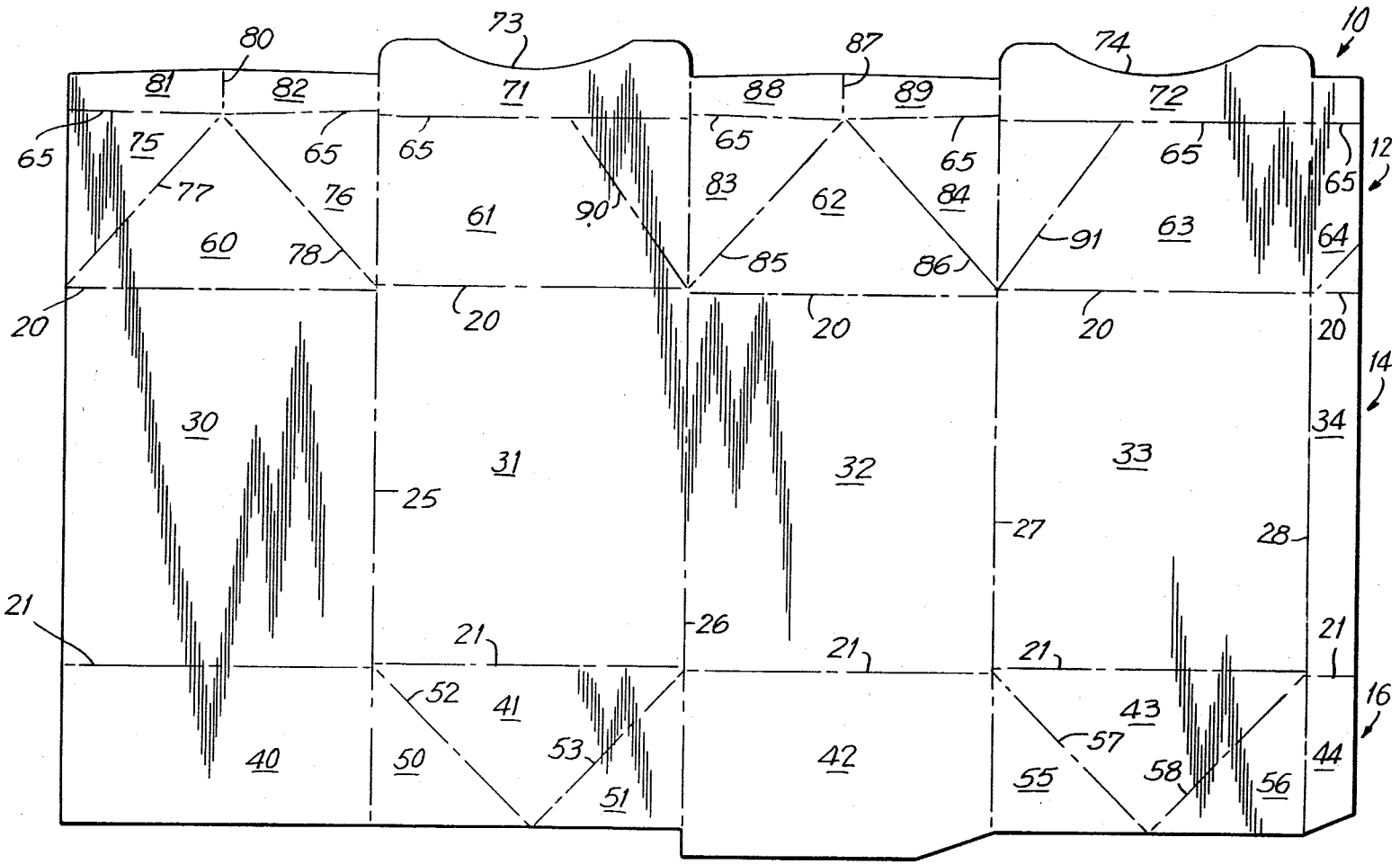
FIG. 1 is a plan view illustrating the outside surface of a cut and scored blank for a carton of the present invention.
Figure 2:
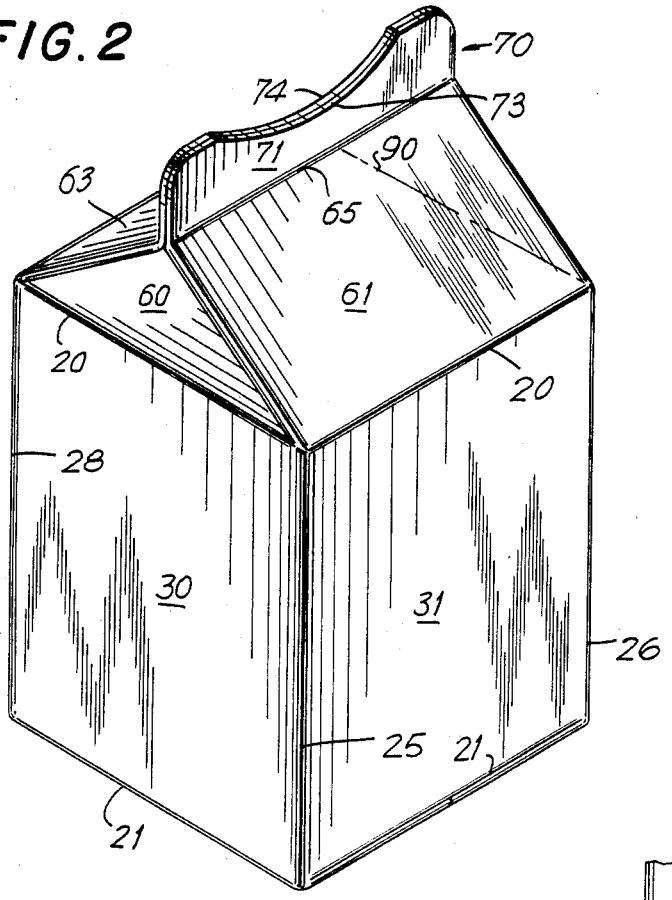
FIG. 2 is a perspective view of the carton erected from the blank of FIG. 1.

Referring now to FIG. 1 of the drawings, the numeral 10 denotes generally the blank of this invention, the blank being formed of a single piece of stiff, foldable and resilient material such as paperboard coated on both sides with a heat sealable thermoplastic material, for example polyethylene. The coated blank is cut and scored to form a rectangular carton with a flat bottom and a gable-top as shown in FIG. 2. Forming and sealing of such carton is described in U.S. Pat. No. 3,120,335, issued Feb. 4, 1964.

The blank 10 can be divided into three main portions including a top portion 12, a central portion 14, and a bottom portion 16.

The central portion 14 of the blank 10 is comprised of a plurality of body panels between transverse fold lines 20, 21 which become the tubular body of the carton when erected. The central portion 14 includes a first side panel 30, a front panel 31, a second side panel 32, a rear panel 33, and a first sealing flap 34 serially connected to one another along respective longitudinal fold lines 25, 26, 27, 28.

It should be understood, however, that references in this description to "front", "rear", and "side" are for convenience of description, and such terms are not intended to be used in a limiting way. It is also noted that the transverse fold lines 20, 21 are not continuous lines, rather they are formed in a staggered relationship to accommodate the thickness of the blank as it is bent along the various fold lines to prevent excessive accumulation of paperboard at the junctures where the fold lines come together. However, whether the fold lines are staggered or continuous is not essential to the practice of the present invention.

The bottom portion 16 of the blank 10 is comprised of bottom closure panels 40, 41, 42, 43 and a second sealing flap 44 foldably connected to, and integral with, lower ends of the panels 30, 31, 32, 33 and flap 34, respectively, along the fold line 21. The bottom panel 41 is flanked by fold-back flaps 50, 51 foldably connected thereto along diagonal fold lines 52, 53, respectively. Likewise, bottom panel 43 has fold-back flaps 55, 56 foldably connected to it along diagonal fold lines 57, 58, respectively. In addition to the aforementioned '335 patent, U.S. Pat. No. 3,120,333, issued Feb. 4, 1964, illustrates a typical well-known bottom closure as herein described.

Figure 3:
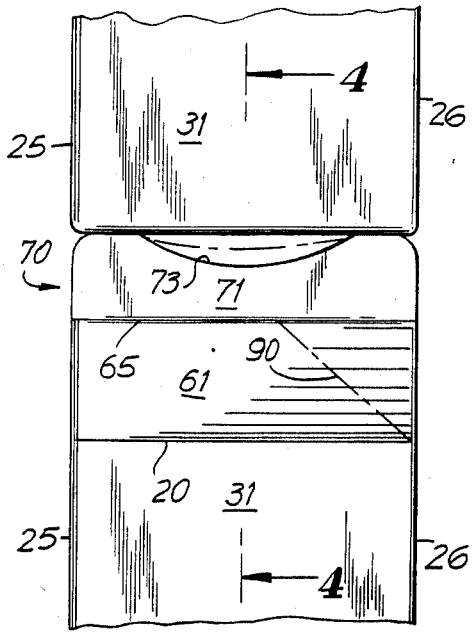
FIG. 3 is a fragmentary elevation view showing the carton of FIG. 2 in stacked arrangement with a similar carton.
Figure 4:
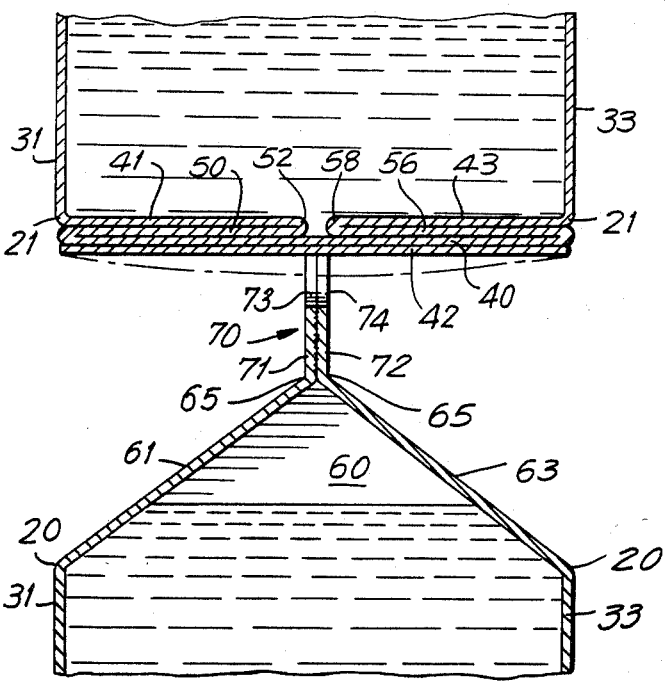
FIG. 4 is an enlarged fragmentary sectional view, taken along line 4—4 of FIG. 3, showing the carton of FIG. 2 in stacked arrangement with a similar carton.

The top portion 12 of the blank 10 is comprised of top closure panels 60, 61, 62, 63 and a third sealing flap 64 foldably connected to, and integral with, upper ends of the panels 30, 31, 32, 33 and flap 34, respectively, along the fold line 20. Sections of the top portion 12 of the blank 10 beneath a transverse fold line 65 define roof and end panels of the carton top closure, while sections of such top portion above the fold line 65 define an upwardly extending central rib 70 (FIGS. 2–4). Panels 61, 63 form the top roof panels of the carton; each is connected to the upper end of the non-adjacent body panels 31, 33, respectively, along the fold line 20. Surmounting these roof panels and foldably connected thereto at an upper end thereof along the fold line 65 are upwardly extending rib panels 71, 72, respectively, which form the sides of rib 70.

The side rib panels 71, 72 are formed with recessed upper edges 73, 74, respectively. The recess feature provides a greater panel height at the ends of the panel than the height of such panel between those ends. This will reduce the amount of contact between stacked cartons, namely the contact between upper edges of the side rib panels of one carton with a bottom closure of another carton stacked thereon, illustrated in FIG. 3. However, although an arcuately defined or concave upper edge is preferred, other edge configurations may be employed in the practice of this invention. For example, although not shown in the drawings, it is contemplated that each rib panel can include a pair of opposed bearing tabs attached along the upper edge of the panel, at respective ends thereof. In this case, the recessed edge, mentioned earlier, would be partially defined by those tabs.

Panels 60, 62 form the triangular ends of the top closure of the carton; each is connected to the upper end of the non-adjacent body panels 30, 32, respectively, along the fold line 20. The top panel 60 is flanked by a pair of triangular fold-back flaps 75, 76 foldably connected thereto along diagonal fold lines 77, 78, respectively. An upwardly projecting extension of top panel 60 is divided by a vertical fold line 80 into end rib flaps 81, 82. The top panel 62 is flanked by a pair of triangular fold-back flaps 83, 84 foldably connected thereto along diagonal fold lines 85, 86, respectively. An upwardly projecting extension of top panel 62 is divided by a vertical fold line 87 into end rib flaps 88, 89.

Referring now to FIGS. 2, 3, and 4 of the drawings, the blank 10 of FIG. 1 is erected into a carton by folding the blank lengthwise along the fold lines 25, 26, 27, 28 and then forming a liquid-tight side seam in a conventional manner, such as by heating the surfaces to a polyethylene softening temperature, to first form the tubular body. Then the bottom closure panels 41, 43 are folded inwardly along the fold lines 21, 52, 53 and 21, 57, 58, respectively. The bottom panels 40, 42 are folded inwardly and the bottom is sealed, as is well-known in the art, to provide a liquid-tight carton bottom. After product is inserted in the carton, the top closure is then ready to be formed.

The opposed top end panels 60, 62 are folded inwardly along the fold lines 20, 77, 78 and 20, 85, 86, respectively. At the same time, the opposed top roof panels 61, 63 are inclined toward each other to overlie the body, and the fold-back panels 75, 76, 83, 84 are folded about the various fold lines to respective positions underlying the roof panels 61, 63 and being substantially adjacent an underside surface of one of them. This will bring the end panels 60, 62 between the roof panels 61, 63 from opposite ends thereof. Also, it will fold the end rib panels 81, 82, 88, 89, surmounting a respective one of the fold-back flaps, against each other and an inner surface of a respective one of the side rib panels 71, 72. The top closure is then sealed by well-known techniques to form a gable-top carton with its ridge in a vertical position. The side rib panels 71, 72 are secured together at least along the upper edges thereof.

It will be apparent that an extensible pouring spout, housed in a collapsed condition within the sealed carton, is provided, and it is defined in part by the folded-in top end panel 62, by the adjacent pair of folded-back flaps 83, 84, by the adjacent pair of end rib flaps 88, 89, by adjacent portions of the roof panels 61, 63, and by adjacent portions of the side rib panels 71, 72. A diagonal fold line 90 extending across top panel 61 and a diagonal fold line 91 extending across top panel 63 are provided to facilitate spout opening. Gable-top cartons with an extensible pouring spout are well-known, and an example of such cartons is illustrated in U.S. Pat. No. 3,270,940, issued Sept. 6, 1966.

Because the bottom end of a filled carton has a tendency to bulge outwardly (illustrated by a broken line in FIGS. 3 and 4), and a weeper condition is most likely to occur in the central portion of such bulge, a recessed rib construction of the present invention will minimize contact between vertically stacked cartons by permitting a stacked carton to be supported at the ends of the vertical rib of the supporting carton instead of along the entire length of rib, as shown in FIG. 3.

While a preferred embodiment of the invention has been shown and described, it should be understood that there may be other carton constructions and modifications which fall within the spirit and scope of this invention as defined by the following claims.

What is claimed is:

1. In a gable-top carton formed from a blank of thermoplastic coated paperboard, and including a tubular body having four side panels and a sealing flap, a bottom closure thereon, a pair of opposed top roof panels inclined toward each other and overlying the body, a pair of opposed triangular top end panels folded inwardly between the roof panels from opposite ends thereof, two pairs of triangular folded-back flaps, each pair of which being integral with a respective one of the top end panels along fold lines which underlie the roof panels, the folded-back flaps being substantially adjacent an underside surface of a respective one of the roof panels, an upwardly extending side rib panel integral with and surmounting each of the roof panels, two pairs of folded-in end rib flaps, each end rib flap being integral with and surmounting a respective one of the folded-back flaps, the end rib flaps of each pair being folded to lie against each other and an inner surface of a respective one of the side rib panels, an extensible pouring spout housed in collapsed condition within the carton and defined in part by one of the top end panels, by an adjacent pair of the folded-back flaps, by an adjacent pair of the end rib flaps, and by adjacent portions of the roof and side rib panels, the side rib panels being secured together at least along the upper edges thereof, the improvement characterized by the side rib panels having a height at the ends thereof greater than the height of such panels between and midway of such ends to reduce the amount of contact between the upper edges of the side rib panels with the bottom closure of another carton stacked thereon.

2. The carton of claim 1 wherein the side rib panels each have a recessed arcuate upper edge.

3. The carton of claim 2 wherein the upper edges of the side rib panels are concave.

4. The carton of claim 1 wherein the side rib panels each have a pair of opposed bearing tabs attached along the upper edge of such panel at respective ends thereof for supporting another such carton stacked thereon.

5. A blank of thermoplastic coated paperboard for constructing a gable-top carton comprising:

(a) a plurality of body panels including four side panels and a first sealing flap serially connected to one another along respective longitudinal fold lines;

(b) a bottom closure including four bottom panels, each foldably connected to a lower end of one of the body panels, and a second sealing flap foldably connected to a lower end of the first sealing flap, all being connected along a transverse fold line;

(c) a pair of top roof panels, each foldably connected to an upper end of one of two non-adjacent body panels along a transverse fold line;

(d) a pair of triangular top end panels, each foldably connected to upper end of one of the other two non-adjacent side panels along a transverse fold line and adapted to fold inwardly between the first and second top roof panels from opposite ends thereof;

(e) a pair of triangular flaps foldably connected to each of the top end panels along diagonal fold lines, each being adapted to be folded substantially adjacent an underside surface of one of the top roof panels; and (f) a pair of side rib panels having a recessed upper edge, each panel foldably connected to an upper end of one of the top roof panels along a transverse fold line and adapted to be secured together with the other in a vertical position;

(g) whereby when said pair of side rib panels are secured together in a vertical position they form a recessed top having a height at the ends thereof greater than the height of such rib panels between and midway of such ends, to reduce the amount of contact between the upper edges of the side rib panels with the bottom closure of another carton stacked thereon.

6. The blank of claim 5 wherein the recessed upper edges of the side rib panels are arcuate.

7. The blank of claim 6 wherein the arcuate upper edges of the side rib panels are concave.

8. The blank of claim 5 wherein the recessed upper edge of each side rib panel is partially defined by a pair of opposed bearing tabs, each tab being attached to such panel at a respective end thereof.

9. In a vertical, aligned stack of liquid-filled gable-top cartons fashioned from paperboard coated with a thermoplastic material, each carton having upwardly extending side rib panels, the improvement characterized by the side rib panels of a lower carton of the stack having a height at the ends thereof greater than the height of such rib panels centrally between such ends, the bottom closure of an immediately upper adjacent carton of the stack resting on and being supported on said upwardly extending side rib panels of said lower carton of the stack, whereby the amount of contact between the upper edges of the upwardly extending side rib panels and the central portion of the bottom closure of said upper adjacent carton is reduced.

10. The stack of claim 9 wherein the said side rib panels each have a recessed arcuate upper edge.

11. The stack of claim 10 wherein the upper edges of said side rib panels are concave.

* * * * *